United States Patent [19]

Dhuyvetter

[11] 4,078,775

[45] Mar. 14, 1978

[54] APPARATUS FOR SUPPORTING A CONTINUOUSLY MOVING CAST INGOT IN A CUTTING ZONE

[75] Inventor: Jean-Claude Dhuyvetter, Braydune, France

[73] Assignee: Fives-Cail Babcock, Paris, France

[21] Appl. No.: 630,186

[22] Filed: Nov. 10, 1975

[30] Foreign Application Priority Data

Nov. 8, 1974 France ..... 74 37038

[51] Int. Cl.[2] ..... B23K 7/00

[52] U.S. Cl. ..... 266/50; 266/902

[58] Field of Search ..... 164/263, 264, 282; 266/50, 902; 148/9 R, 9.6

[56] References Cited

U.S. PATENT DOCUMENTS

| | | | |
|---|---|---|---|
| 3,382,112 | 5/1968 | Oxley et al. | 266/50 X |
| 3,443,803 | 5/1969 | Wernicke | 266/50 |
| 3,511,489 | 5/1970 | Field | 266/50 |
| 3,588,066 | 6/1971 | Reinfeld et al. | 266/50 |

*Primary Examiner*—Roy Lake
*Assistant Examiner*—Paul A. Bell
*Attorney, Agent, or Firm*—Kurt Kelman

[57] ABSTRACT

In a continuous ingot casting installation, a table of ingot support rollers is arranged in the horizontal cutting zone. This table is arranged between an upstream and a downstream set of ingot support rollers and is reciprocably displaceable therebetween in the direction of the path of movement of the continuously cast ingot and parallel to that of the displacement of a cutting machine. The table is displaced automatically in a direction opposite to that of the cutting machine each time the oxygen torch of the machine approaches one of the rollers of the table and returned to its initial position. In this way, billets are cut from the cast ingot.

11 Claims, 3 Drawing Figures

APPARATUS FOR SUPPORTING A CONTINUOUSLY MOVING CAST INGOT IN A CUTTING ZONE

The present invention relates to improvements in an installation for continuously casting an ingot from molten metal and for supporting the continuously moving cast ingot along a path wherealong it is first cooled and then cut into desired lengths in a horizontally extending cutting zone. The ingot is cut by means of a cutting machine comprising an oxygen cutting or blow torch. The cutting machine advances in the direction of travel of the cast ingot so as to effect a cut of a particular length without requiring a discontinuation of the casting operation and is then returned rapidly to its initial position.

In installations for the production of billets, the course of the cutting machine is relatively important and it is necessary to support the traveling ingot at several points between the two ends of this course. Fixed ingot supports, such as rollers, cannot be used for this purpose because they would be rapidly worn and made useless by the flame of the oxygen cutting torch.

One known solution to this problem consists of mounting the ingot support rollers individually on arms or like supports which are automatically lowered at the approach on the cutting torch and are raised again as the cutting torch moves away.

Another known solution consists of supporting the cast ingot on rollers interconnected by articulated links in the manner of a chain whose movements are synchronized with those of the cutting machine so that the blow torch is always positioned between the rollers.

These two known solutions necessitate complex mechanisms which are expensive and difficult to maintain.

It is the primary object of this invention to provide support apparatus of the indicated type which is simple, sturdy and easy to maintain.

This and other objects are accomplished in accordance with the invention with the combination of a first set of fixed driven ingot support rollers upstream of the cutting zone, a second set of fixed driven ingot support rollers downstream of the cutting zone, a reciprocably displaceable table of driven ingot support rollers mounted in the cutting zone between the first and second set of rollers, and means automatically responsive to the displacement of the cutting machine to displace the table opposite to the direction of displacement of the cutting machine each time the cutting torch approaches one of the rollers of the table and to return the table to its original position, the table moving at a speed in excess of the speed of displacement of the cutting machine. The rollers are spaced along the table in the direction of the path and include a first and a last roller respectively at the upstream and downstream ends of the table. The first and second sets of rollers each includes respectively a last roller spaced from the first roller of the table and a first roller spaced from the last roller of the table, and the maximal spacing between the first roller of the table and the last roller of the first set of rollers, and the last roller of the table and the first roller of the second set of rollers is of the same order of magnitude as the spacing between the rollers of the table. The table is reciprocably displaceable in the direction of the path a distance equal to a fraction of the spacing.

The above and other objects, advantages and features of the invention will become more apparent from the following detailed description of a now preferred embodiment thereof, taken in conjunction with the accompanying drawing wherein.

Figure 1:
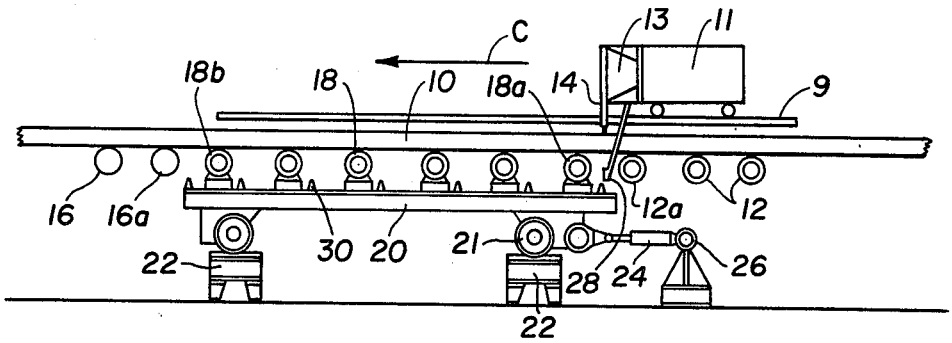
FIG. 1 is a side elevational view of the cutting zone of a continuous casting installation.

Since installations for continuously casting an ingot from molten metal and for supporting the continuously moving cast ingot along a path are well known, the description and drawing has been limited to the horizontally extending cutting zone of such an installation. The cooled ingot 10 travels in the direction of horizontal arrow C shown in FIG. 1 and, as it enters the cutting zone, it is supported upstream by a first set of fixed, power-driven ingot support rollers 12 including a last roller 12*a*. Ingot 10 is cut into predetermined lengths by means of cutting machine 13 comprising oxygen cutting torch 14. The cutting machine is displaced at the same speed as the ingot during the cutting operation parallel to the path of the ingot and the cut lengths are removed from the cutting zone by a second set of fixed, power-driven rollers 16 downstream of the cutting zone. A reciprocably displaceable table of power-driven ingot support rollers 18 mounted on frame 20 is arranged between last roller 12*a* of the first set of fixed rollers and first roller 16*a* of the second set of fixed rollers. Thus, in the cutting zone wherein the cutting torch is displaced, the ingot is supported by the similarly displaceable rollers 18, while rollers 12 and 16 are not displaceable along the path of the ingot, i.e. they are fixed in position.

In the illustrated embodiment, support frame 20 for rollers 18 is mounted on wheels 21 which support the table of rollers 18 on horizontal rails 22, 22. The cutting machine is mounted on wheeled carriage 11 which runs on rails 9, the speed of the carriage and the speed of the ingot support rollers being synchronized.

Rollers 18 are spaced along the table in the direction of the path of travel of ingot 10 and include first roller 18*a* and last roller 18*b* respectively at the upstream and downstream ends of the table. The length of the table and the disposition of the rollers are such that the maximal spacing between first roller 18*a* of the table and last roller 12*a* of the first set of rollers, and last roller 18*b* of the table and first roller 16*a* of the second set of rollers is of the same order of magnitude as the spacing between the rollers 18 of the table, i.e. all the rollers are substantially equidistantly spaced at such maximum spacing.

A means automatically responsive to the displacement of the cutting machine is provided to displace the table opposite to the direction of displacement of the cutting machine each time the cutting torch approaches one of the rollers 18 of the table and to return the table to its original position. The illustrated means for displacing the table comprises double-acting hydraulic jack 24 having its piston rod linked to the table frame and the cylinder connected to fixed bracket 26. The stroke of the jack is equal to a fraction of the spacing between the rollers, preferably about one half of this spacing so as to limit the displacement of the table correspondingly. The extreme positions of the table are determined by stops or limit switches which limit the stroke of the jack.

In a well known manner requiring no detailed description or illustration, the flow of hydraulic fluid to jack 24 is controlled by a solenoid valve 31 which thus controls the operation of the jack and the corresponding displacement of the table of rollers 18. The solenoid valve is actuated by a control circuit 32 which includes circuit breaker 28 mounted on cutting machine 13 and moving therewith. The circuit breaker is actuated by a series of cams 30 on the table and associated with a respective one of rollers 18 so that the circuit breaker is tripped when cutting torch 14 approaches one of the rollers, i.e. each cam is positioned downstream of the associated roller and their spacing is the same as the spacing between the rollers, one additional cam being associated with the last roller 18*b* upstream thereof. When a cam trips circuit breaker 28, the control circuit will move the solenoid valve and so control the flow of hydraulic fluid in jack 24 as to displace the table of rollers 18.

Obviously and equivalently, a circuit breaker may be associated with each roller 18 while the cutting machine carries a cam for tripping these circuit breakers.

The cams or circuit breakers associated with each roller 18 may successively control the displacement of the table of rollers 18 in the same direction as cutting machine 13 and then its displacement in the opposite direction. Alternatively, two cams or circuit breakers may be associated with each roller 18, one to control the upstream movement of the table and the other one to control the return of the table to its initial position.

Figure 3:
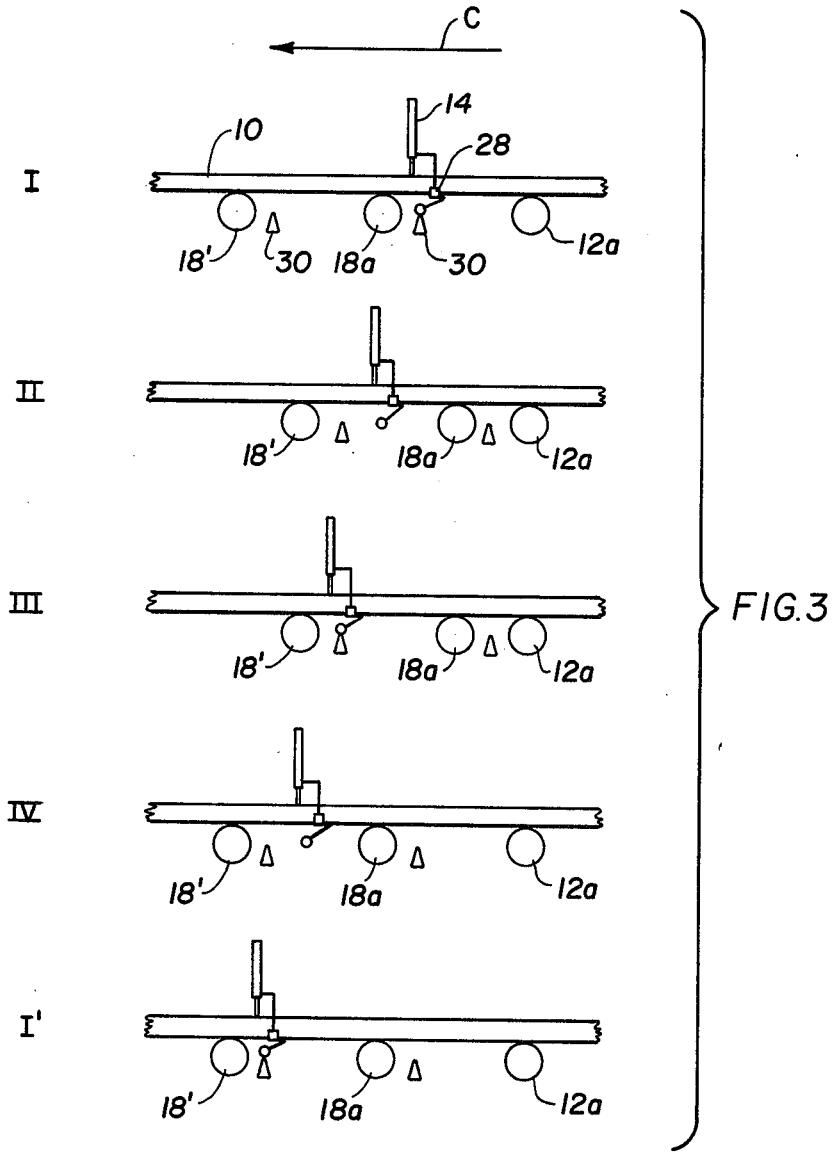
FIG. 3 schematically illustrates the operation.

The operation of the above-described apparatus is schematically shown in FIG. 3.

At the beginning of the cutting operation, as ingot 10 and cutting torch 14 travel in the direction of arrow C, the table of rollers 18 is displaced its maximum distance from downstream rollers 12, i.e. there is a maximal spacing between last roller 12*a* of the first set of fixed rollers and first roller 18*a* of the displaceable table of rollers. In stage I, as cutting torch 14 approaches roller 18*a*, cam 30 associated with this roller downstream thereof actuates circuit breaker 28 which controls jack 24 so as to displace the table of rollers 18 in a direction opposite to that of the displacement of the cutting torch so as to position it between successive ones of the rollers of the displaceable table, as shown in stage II. To limit the time each roller 18 dwells below the cutting torch, the displacement of the table is effectuated as rapidly as possible.

In stage III, when the cutting torch approaches successive roller 18′, cam 30 associated with this roller actuates circuit breaker 28 to operate jack 24 so as to return the table to its initial position shown at stage IV, wherein the torch again is positioned intermediate the successive rollers.

Since jack 24 is arranged to displace the table of rollers 18 at a speed in excess of the speed of displacement of the cutting machine, cutting torch 14 reaches the successive roller 18′ only at the end of a certain time (stage I′), at which time the cam associated with this roller will again actuate the circuit breaker so as to cause the table to be displaced upstream. This cycle of operation is repeated for each roller 18 of the displaceable table until the cutting operation has been completed. At this point, the cutting torch is deactivated and the cutting machine as well as the table of rollers 18 are returned to their initial positions. For this purpose, it may be preferred to provide means for automatically inactivating the cutting torch during the last movement of the table in the opposite direction and, if desired, cam 30 may control the deactivating means.

As will be clear from the above-described operation, cutting torch 14 is positioned above an ingot support roller only when the table of rollers 18 is displaced upstream. Since the displacement speed of the table is relatively high, the torch is aligned with a roller only for a brief moment.

Figure 2:
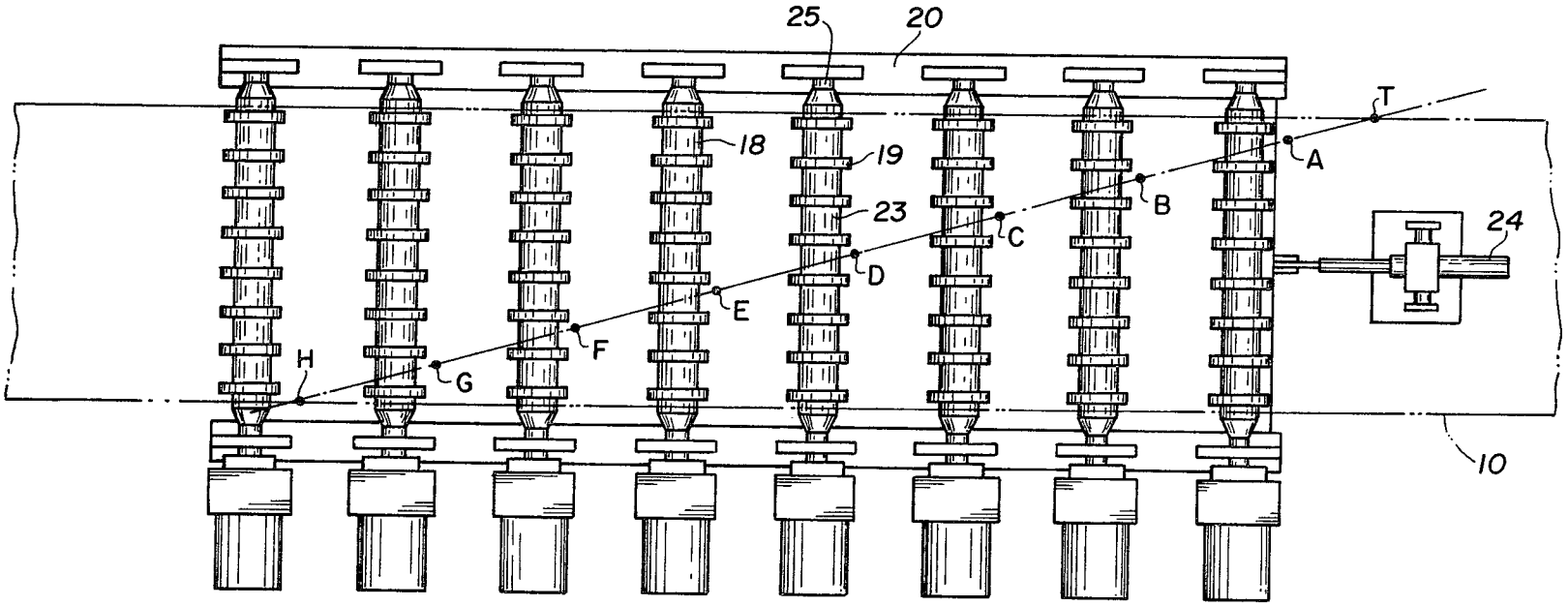
FIG. 2 is an enlarged plan view of the table of driven support rollers in the cutting zone.

In the preferred embodiment shown in FIG. 2, rollers 18 are comprised of a plurality of discs 19 keyed to rotary shafts 25 rotatably journaled on frame 20 of the table, the discs being spaced apart in a direction transverse to the path of travel of ingot 10. The discs are held in position on the shaft by spacing sleeves 23 of smaller diameter than the discs. The discs and cutting torch will always be positioned between two adjacent discs 19 when it passes a roller, as shown in FIG. 2 where line T represents the trajectory followed by torch 14 during the cutting operation, assuming that only one torch is used. Points A to H are the points reached by the torch when the table is displaced upstream. In this way, the cutting torch will not harm the roller discs and its deteriorating effect on spacing discs 23 will be minimal in view of the small diameter thereof.

Furthermore, it is possible to deactivate the oxygen torch and to halt its transverse movement each time it passes over a roller 18 and then immediately thereafter to operate it again, which operations may also be automatically controlled by the same control circuit which controls the displacement of the table of rollers 18.

The apparatus hereinabove described will be particularly useful in the continuous production of billets.

What is claimed is:

1. In an installation for continuously casting an ingot and for supporting the continuously moving cast ingot along a path including a horizontally extending cutting zone, which comprises an ingot cutting machine comprising an oxygen cutting torch in the cutting zone, the cutting machine being displaceable parallel to the path: the combination of 1. a first set of fixed driven ingot support rollers upstream of the cutting zone,
2. a second set of fixed driven ingot support rollers downstream of the cutting zone,
3. a reciprocably displaceable table of driven ingot support rollers mounted in the cutting zone between the first and second set of rollers,
   a. the rollers being spaced along the table in the direction of the path and including a first and a last roller respectively at the upstream and downstream ends of the table,
   b. the first and second sets of rollers each including respectively a last roller spaced from the first roller of the table and a first roller spaced from the last roller of the table,
   c. the maximal spacing between the first roller of the table and the last roller of the first set of rollers, and the last roller of the table and the first roller of the second set of rollers being of the same order of magnitude as the spacing between the rollers of the table, and
   d. the table being reciprocably displaceable in the direction of the path a distance equal to a fraction of the spacing, and
4. means automatically responsive to the displacement of the cutting machine to displace the table opposite to the direction of displacement of the cutting machine each time the cutting torch approaches one of the rollers of the table and to return the table to its original position, a. the means to displace the table moving the table at a speed in excess of the speed of displacement of the cutting machine.

2. In the installation of claim 1, horizontal rail means in the cutting zone and wheels supporting the table on the rail means for displacement therealong.

3. In the installation of claim 1, the means to displace the table comprising a double-acting hydraulic jack connected to the table.

4. In the installation of claim 1, the displacement distance of the table being substantially equal to one half of the spacing between the rollers of the table.

5. In the installation of claim 1, the means to displace the table comprising a circuit breaker mounted on the cutting machine, and a series of cams on the table and arranged to actuate the circuit breaker, each of the cams being associated with a respective one of the rollers of the table to actuate the circuit breaker when the cutting torch approaches one of the rollers and to displace the table in an upstream direction.

6. In the installation of claim 1, means for automatically inactivating the cutting torch during the movement of the table in the opposite direction.

7. In the installation of claim 1, the means to displace the table comprising a circuit breaker mounted on the cutting machine, and a series of cams on the table and arranged to actuate the circuit breaker, each of the cams being associated with a respective one of the rollers of the table to actuate the circuit breaker when the cutting torch approaches one of the rollers and to displace the table in an upstream direction, and means for automatically inactivating the cutting torch during the movement of the table in the opposite direction, the cams controlling the deactivating means.

8. In the installation of claim 1, each of the rollers of the table being comprised of a plurality of discs spaced apart in a direction transverse to the path, the discs of each roller and the cutting torch being so arranged relative to each other that the cutting torch will be positioned between two adjacent ones of the discs when it passes the rollers.

9. In the installation of claim 5, each of the cams except the first cam being arranged to actuate the circuit breaker two times in sequence, the table being displaced in one of the directions of reciprocation when the cam actuates the circuit breaker the first time and in the opposite direction when the cam actuates the circuit breaker the second time.

10. A method of cutting a moving strand with the aid of at least one cutting means during the continuous casting of metals, especially steel, comprising the steps of: cutting the strand with a cutting means traveling essentially in synchronism with the strand and movable transversely with respect to the direction of travel of the strand, supporting the strand during cutting thereof by means of at least one movable support roll, moving the support roll through a given displacement path in a first direction, while maintaining its strand support function, with sufficient rapidity past the cutting means when the cutting means comes into the vicinity of said support roll so that the support roll is not appreciably detrimentally affected by the action of the cutting means, and during travel of the strand, when the cutting means has moved away from the support roll through a distance corresponding to at least said given displacement path, moving the support roll in a direction opposite said first direction while again maintaining the strand support function of said support rolls.

11. Apparatus for cutting a moving continuously cast strand with at least one cutting torch, a cutting torch carriage mounting said cutting torch for movement in synchronism with the strand and for movement transverse to the strand motion, at least one support roll for supporting said strand while it is being cut, means mounting said support roll such that the roll can be moved away from the torch when it is located at the region of the cutting torch jet, the improvement comprising: said support roll mounting means being adapted to move said roll through the cutting torch jet when the cutting torch comes into the neighborhood of said roll such that the roll is moved through a given displacement path opposite to the direction of travel of the strand while maintaining said roll's support function and when the cutting torch has moved away from the support roll moving the roll back to its starting position while maintaining its support function.

* * * * *